US009656315B2

(12) United States Patent
Renz

(10) Patent No.: US 9,656,315 B2
(45) Date of Patent: May 23, 2017

(54) PRODUCING COMPOSITE FIBER/METAL WORKPIECES

(71) Applicant: TRUMPF Werkzeugmaschinen GmbH + Co. KG, Ditzingen (DE)

(72) Inventor: Bernd Renz, Marbach am Neckar (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 289 days.

(21) Appl. No.: 14/384,196

(22) PCT Filed: Mar. 8, 2013

(86) PCT No.: PCT/EP2013/054711

§ 371 (c)(1),
(2) Date: Sep. 11, 2014

(87) PCT Pub. No.: WO2013/135572

PCT Pub. Date: Sep. 19, 2013

(65) Prior Publication Data

US 2015/0074970 A1 Mar. 19, 2015

(30) Foreign Application Priority Data

Mar. 13, 2012 (EP) ..... 12159180

(51) Int. Cl.
*B21D 49/00* (2006.01)
*B21D 39/03* (2006.01)

(52) U.S. Cl.
CPC ..... *B21D 39/03* (2013.01); *B21D 39/032* (2013.01); *B21D 49/00* (2013.01); *Y10T 29/49826* (2015.01); *Y10T 29/53961* (2015.01)

(58) Field of Classification Search
CPC ..... B21D 39/03; B21D 49/00; B21D 39/032; Y10T 29/53961; Y10T 29/4982
See application file for complete search history.

(56) References Cited

U.S. PATENT DOCUMENTS 3,406,446 A 10/1968 Muldovan
5,562,245 A 10/1996 Berthelemy et al.
(Continued)

FOREIGN PATENT DOCUMENTS

CN 1207062 A 2/1999
CN 1929990 A 3/2007
(Continued)

OTHER PUBLICATIONS

Notification of Transmittal of Translation of the International Preliminary Report on Patentability for corresponding PCT Application No. PCT/EP2013/054711, mailed Sep. 25, 2104, 10 pages.
(Continued)

*Primary Examiner* — Richard Chang
(74) *Attorney, Agent, or Firm* — Fish & Richardson P.C.

(57) ABSTRACT

Methods, systems and apparatus for producing composite fiber/metal workpieces. In one aspect, a method includes locating a metal workpiece on a workpiece support of a machine tool, processing the metal workpiece located on the workpiece support to produce one or more shaped features on the metal workpiece, fitting a fiber fabric to the metal workpiece in a region of the shaped features, and connecting the fiber fabric to the metal workpiece in at least one of a non-positive-locking connection or a positive-locking connection to produce a composite fiber/metal workpiece.

12 Claims, 5 Drawing Sheets

(56) References Cited

U.S. PATENT DOCUMENTS

| | | | | |
|---|---|---|---|---|
| 5,642,851 | A | 7/1997 | Berthelemy et al. | |
| 5,961,409 | A | 10/1999 | Ando | |
| 7,210,328 | B2 | 5/2007 | Strasser | |
| 7,910,145 | B2 * | 3/2011 | Reati | B26F 1/40 426/425 |
| 9,428,329 | B2 * | 8/2016 | Trombetta | B65D 85/8043 |
| 2006/0179913 | A1 | 8/2006 | Strasser | |

FOREIGN PATENT DOCUMENTS

| | | | |
|---|---|---|---|
| DE | 69425418 | T2 | 3/2001 |
| DE | 202005004407 | U1 | 6/2005 |
| DE | 102006049014 | A1 | 4/2008 |
| EP | 1533393 | A2 | 5/2005 |
| EP | 2177293 | A1 | 4/2010 |
| WO | WO9720647 | A1 | 6/1997 |
| WO | WO2005075189 | A2 | 8/2005 |
| WO | 2011147387 | A1 | 12/2011 |
| WO | WO2011147387 | A1 | 12/2011 |

OTHER PUBLICATIONS

International Search Report from corresponding PCT Application No. PCT/EP2013/054711, mailed May 8, 2013, 6 pages.

* cited by examiner 22
18e
18d
18a 22
18e
18d
18a 22
18e
18a
18d
2

22
18e
18a
18d
2

18f
18g
18a
18d

18a 2
18a
14

18g
2

PRODUCING COMPOSITE FIBER/METAL WORKPIECES

CROSS REFERENCE TO RELATED APPLICATIONS

This application is a national stage of and claims priority under 35 U.S.C. §371 to PCT Application No. PCT/EP2013/054711 filed on Mar. 8, 2013, which claimed priority to European Application No. 12 159 180.4, filed on Mar. 13, 2012. The contents of both of these priority applications are hereby incorporated by reference in their entirety.

TECHNICAL FIELD

This specification relates to methods, systems and apparatus for producing composite fiber/metal workpieces.

BACKGROUND

On lightweight composite fiber/plastics material components, it is often necessary to integrate metal parts as force introduction locations or as interfaces to metal components. In order to produce such composite fiber/metal workpieces or components, a metal workpiece can be reinforced with fibers at selected locations.

DE 694 25 418 T2 discloses a method in which a workpiece is provided with a groove in which a previously produced pre-form of fibers and a plating metal is introduced. By means of subsequent isothermic forging, the pre-form is welded to the workpiece.

EP 1 533 393 B1 discloses a method for producing a composite fiber/metal workpiece, in which a fiber pre-form which is accommodated in a cartridge and a filler metal are placed in an annular groove between two metal workpieces. The metal workpieces are connected to the fiber pre-form and the filling metal by means of application of heat and pressure or by means of diffusion welding.

In both cases, the connection of the fiber fabric to the metal workpiece is carried out by means of a thermal processing operation (welding) or by means of adhesion of the metal matrix. These methods are therefore linked with a high level of complexity and require a comparatively large proportion of manual operating steps.

SUMMARY

One aspect of the invention features a method for producing a composite fiber/metal workpiece on a machine tool, including the steps of: loading a workpiece support of the machine tool with a metal, preferably plate-like, workpiece, in particular with a sheet metal panel; processing the workpiece located on the workpiece support by means of a processing device for producing one or more shaped features on the workpiece; fitting a fiber fabric to the workpiece located on the workpiece support in the region of the shaped features; and connecting the fiber fabric to the workpiece in a non-positive-locking and/or positive-locking manner by processing the workpiece using the processing device, preferably in the region of the shaped portions, to produce the composite fiber/metal workpiece. This method can reduce the complexity when composite fiber/metal workpieces are produced and in particular the number of manual interventions in the process.

To produce the shaped portions, the workpiece can be plastically deformed by means of the processing device. The shaped portions are three-dimensional changes in the structure of the workpiece which are suitable for producing a non-positive-locking and/or positive-locking connection to a fiber fabric, that is to say, the shaped portions are intended, in the case of a plate-like workpiece, to typically protrude beyond the workpiece plane or protrude therefrom.

The fitting of the fiber fabric to the workpiece is preferably carried out in a positive-locking manner or in such a manner that the fiber fabric after fitting can be moved together with the workpiece in the processing plane, without the occurrence of a relative movement between the workpiece and fiber fabric. In order to fix the fiber fabric during fitting to the workpiece, it is possible to use shaped portions which have been previously formed at that location and to which the fiber fabric can be secured, for example, by the shaped portions being wound with fiber rovings. Alternatively, recesses which are also provided on a fiber mat can be brought into engagement with the shaped portions and/or the geometry of the fiber mat can be adapted in such a manner that it fits between the shaped portions in a positive-locking manner.

The non-positive-locking and/or positive-locking connection of the fiber fabric to the workpiece is carried out by means of a direct transmission of force between the fiber fabric and the metal workpiece, in particular by means of deforming processing of the workpiece at the shaped portions so that a thermal processing operation (welding) can be dispensed with. The non-positive-locking and/or positive-locking connection can be carried out in this instance on the machine tool which is also used to produce the shaped portions in the workpiece so that a transfer of the workpiece between the shaping processing operation of the workpiece and the connection process between the workpiece and fiber fabric is not necessary. The method thus enables automated production of a composite fiber/metal workpiece in a single operating step so that composite fiber/metal workpieces can be produced in an economical and highly durable manner.

The method preferably involves punching processing of the workpiece in order to produce the shaped portions before and/or during the non-positive-locking and/or positive-locking connection of the fiber fabric to the workpiece. Owing to the punching operation, shaped portions, for example, in the form of rim-holes (round recesses whose edges are shaped upwards or downwards), crimped portions (groove-like recesses), gill-like vents (crimped portions with an opening), etc., can be produced. Of course, the listing given here makes no claim to be complete, that is to say, shaped portions of types other than those listed here can be used in order to produce a non-positive-locking and/or positive-locking connection between the workpiece and the fiber fabric. The processing device can also optionally be constructed, alternatively or in addition to a punching processing operation for producing the non-positive-locking and/or positive-locking connection, to enable a different type of shaping processing operation, for example, by means of a bending processing operation.

In a variant, the step of fitting the fiber fabric includes supplying at least a portion of the fiber fabric in the form of a fiber mat to the workpiece which is located on the workpiece support. The fiber mat may, for example, be cut from a fiber fabric or be produced using a stitching technique. In the latter case, it may be a two-dimensional fiber fabric which is produced on a textile machine and in which fiber rovings are placed on a stitching base and secured to the stitching base, for example, by means of zig-zag stitches. The shape and size of the fiber mat is in this instance typically constructed in such a manner or is cut in such a manner that, in order to form the composite workpiece, no additional (cutting) processing operation has to be carried out, that is to say that the format of the fiber mat typically corresponds to the end shape, as used in the composite workpiece.

The positioning of the fiber mat on the workpiece is preferably carried out in such a manner that at least one shaped portion of the workpiece is brought into engagement with at least one recess formed in the fiber mat. In this manner, the fiber mat is fixed to the workpiece and can be displaced in the processing plane (X/Y direction) together with the workpiece, without sliding in this instance. This is advantageous for the subsequent (shaping) processing operation to produce a permanent connection between the workpiece and fiber fabric since the workpiece typically has to be displaced in the processing plane in order to produce the permanent connection in order to enable a shaping processing operation on the shaped portions. The sliding of the workpiece can optionally also be prevented when the fiber mat has no recesses or through-holes, but instead has an outer edge whose shape and size is adapted to the contour of a region on the workpiece, which region is delimited by a plurality of shaped portions. It is also possible in this instance to carry out a positive-locking connection or fixing which enables a common movement of the workpiece and fiber fabric. It is also possible, before the fiber fabric is fitted to the workpiece, to provide angular shaped portions, for example, in the form of prongs which protrude through the fiber fabric when it is fitted and thus prevent mutual sliding. During the subsequent connection or shaping processing operation, these prongs can be bent and pressed flat, the fibers being clamped and a non-positive-locking connection being produced.

Alternatively or in addition, the step of fitting the fiber fabric may include producing at least a portion of the fiber fabric by fiber strands, which are also occasionally referred to below as fiber rovings, being wound around at least a portion of the shaped portions of the workpiece. In this instance, the workpiece remains on the workpiece support and is typically moved in the workpiece plane relative to a (generally fixed) application device by means of which the fiber strands are secured to the workpiece or wound around the shaped portions.

It is advantageous to produce the application device or to supply the fiber strands in the vicinity of the processing device. In this instance, a shaped portion can be produced and the fiber strands can be wound directly around the shaped portion before the position of the workpiece on the workpiece support is changed in order to produce a shaped portion again at another location. Of course, the application device or the transport device for the fiber strands can optionally also be moved over the workpiece support in order to wind fiber strands around shaped portions at different locations of the workpiece.

The fiber strands are supplied to the workpiece located on the workpiece support, preferably by means of transport from a magazine, for example, by unwinding from a coil. The transport includes an advance movement of the fiber strands from the magazine, which can be produced by means of a drive, for example, by means of a motor for unwinding the coil. It is also optionally possible to dispense with a drive since the fiber strand is automatically drawn by the winding movement. The fiber strands which are transported to the workpiece can be fitted to the workpiece in the region of the shaped portions by means of an application device or they can be wound using the application device. The application device can be constructed in the form of a stitching device and have a tool, for example, in the form of a needle, in order to secure a free end of a fiber strand when the winding on the workpiece begins or to secure it at that location. The application device may also have a separation device, for example, a cutting blade, in order to separate the fiber strand after it has been wound around the shaped portions. The end of the fiber strand fitted to the shaped portions can also be secured to the workpiece, for example, by means of a needle-like tool.

In a development of this variant, the winding around the shaped portions of the workpiece is performed during displacement of the workpiece relative to the (generally fixed) processing device. This displacement is preferably carried out using devices of the machine tool, which serve to displace the workpiece with respect to the processing devices (for example, the processing heads) of the machine tool. These devices are generally constructed as linear drives, by means of which the workpiece can be moved together with the workpiece support and/or relative to the workpiece support, in order to position the workpiece in an appropriate manner in a processing plane (X-Y plane) for the processing operation. The devices for displacing the workpiece are consequently used not only to position the workpiece with respect to the processing device(s) of the machine tool, but also to wind the fiber strands which are supplied to the workpiece around the shaped portions. As set out above, in this instance the or all the shaped portions can first be formed on the workpiece and can then be surrounded by windings in a subsequent step, or a shaped portion can first be formed at a position of the workpiece and it can be surrounded by windings before the workpiece is moved relative to the processing device in order to produce a shaped portion at another position and to surround it with windings, etc.

The non-positive-locking and/or positive-locking connection of the fiber fabric to the workpiece preferably includes deforming of the shaped portions produced on the workpiece. The deforming of the shaped portions, for example, when a fiber mat is used, results in the shaped portions engaging over the recesses in the fiber mat or securely clamping the fiber mat so that the fiber mat can no longer be separated from the workpiece without being damaged and consequently the fiber mat, whose recesses had previously been brought into engagement with the shaped portions, is permanently fixed to the workpiece (connection by means of shaping). The fiber mat and/or the fiber fabric formed by means of winding around the shaped portions can be clamped to the workpiece by means of the shaping processing operation on the shaped portions.

A preferred variant of the method includes applying of at least one plate-like cover, in particular a covering metal sheet, to the fiber fabric which is fitted to the workpiece, the non-positive-locking and/or positive-locking connecting of the fiber fabric to the workpiece involving clamping the fiber fabric between the workpiece and the cover. Preferably, the clamping of the fiber fabric between the workpiece and the cover can be produced by means of a shaping processing operation, for example, by means of a punching process. The cover may be a metal material (covering metal sheet) but it is optionally also possible to use as a cover plastics materials which withstand the forces produced during the shaping or clamping operation.

The clamping of the fiber fabric can be carried out by means of permanent connection (joining) of the workpiece to the fiber fabric and the cover, for example, by means of deformation of flaps which have been produced beforehand on the workpiece, crimping (bending the edge of the shaped portions at a right angle), punch riveting (introducing a connection element), clinching (in a positive-locking and non-positive-locking manner by means of pressing a stamp into the workpiece without the use of additional elements). Of course, the positive-locking and/or non-positive-locking direct connection can be produced between the workpiece and the fiber fabric by means of one or more of the above-described types of shaping processing operations and/or by means of other types of shaping processing operations not described in this instance.

In order to improve the handling, the workpiece is generally constructed so as to be larger than and shaped differently from (generally in a rectangular manner) the component, which is ultimately intended to be used as a composite fiber/metal workpiece. After producing the non-positive and/or positive-locking connection, the composite fiber/metal workpiece can therefore be separated or cut free from the remaining workpiece. In a preferred variant, therefore, the method includes separating processing of the workpiece in order to separate or cut the composite fiber/metal workpiece from the remaining workpiece. The separation of the composite fiber/metal workpiece from the remaining workpiece can be carried out using a punch head, for example, by means of nibbling or by means of a cutting processing operation, for example, by means of laser cutting using a laser processing head.

Another aspect of the invention features a computer program product which is encoded on one or more computer storage media and which has instructions which, when they are carried out by one or more computers, cause the one or more computers to carry out operations which involve the following: loading a workpiece support of the machine tool with a metal workpiece, in particular with a sheet metal panel; processing the workpiece which is located on the workpiece support by means of a processing device for producing shaped portions on the workpiece; fitting a fiber fabric to the workpiece located on the workpiece support in the region of the shaped portions; and non-positive-locking and/or positive-locking connection of the fiber fabric to the workpiece by processing the workpiece using the processing device. The one or more computers can in particular be integrated in a control device of the machine tool or be constructed as a control device of the machine tool. Of course, the variants of the method described above can also be carried out using such a computer program.

Another aspect of the invention features a machine tool for producing composite fiber/metal workpieces, including: a processing device for the shaping processing of workpieces, a workpiece support for supporting a workpiece during the processing operation, and at least one device for fitting a fiber fabric to the workpiece which is located on the workpiece support. The machine tool may, for example, be a punching machine having an (optionally exchangeable) punching head as a processing device, or a punch/laser combination machine having a punch and a laser processing head.

In a preferable embodiment of the machine tool, the device for fitting a fiber fabric is constructed to automatically supply a fiber mat to the workpiece located on the workpiece support and to position the fiber mat on the workpiece. The device for fitting a fiber fabric which is constructed in this manner may be integrated in a loading device for supplying the (metal) workpieces to the workpiece support or be in the form of a separate structural unit. In the first instance, the loading device may have, for example, a plurality of plate-like vacuum suction devices or a (programmable) field of vacuum suction devices which suck or grip a metal workpiece by means of a reduced pressure in order to transport the workpiece from a loading position onto the workpiece support and in order to transport processed workpiece components away from the workpiece support. Such a loading (and unloading) device is marketed, for example, under the name "Sheet Master®" by the Applicant. However, the vacuum suction devices conventionally used are not suitable for gripping or sucking the flexible fiber fabric. In order to suck the fiber fabric, however, it is possible to use vacuum suction devices which are provided, at the side thereof facing the fiber fabric, with an air-permeable component, for example, in the form of an open-pore foam material or a sieve which acts as an abutment face for the fiber fabric and prevents suction of the fiber fabric or portions thereof into the vacuum suction device. It is also favorable to construct vacuum suction devices which are constructed in this manner with a large surface-area (that is to say, with a larger suction face) than vacuum suction devices of a conventional loading device. Of course, the vacuum suction devices for gripping the fiber fabric can be arranged together with vacuum suction devices for gripping the workpiece in a common field of vacuum suction devices.

In order to be able to carry out precise positioning of a fiber mat on the workpiece, the machine tool can have a control device which is constructed or programmed to control the device for fitting the fiber fabric in such a manner that the fiber mat is positioned at the desired location on the workpiece. In particular, the control can be carried out in such a manner that the recesses or apertures which are optionally provided in the fiber mat move into engagement with the shaped portions on the workpiece during positioning or generally in such a manner that a positive-locking fitting of the fiber mat to or between the shaped portions can be produced.

Alternatively or in addition to a device for automatically supplying a fiber mat, a device may also be provided for automatically supplying fiber strands to the workpiece which is located on the workpiece support on the machine tool. This device for automatically supplying fiber strands or fiber rovings may have a magazine for storing fiber strands, for example, a coil.

The device which is constructed to automatically supply fiber strands preferably comprises an application device, which is for securing a respective fiber strand to the workpiece which is located on the workpiece support and for winding round the shaped portions which are formed on the workpiece or for securing the fiber strands to the shaped portions, and which may be constructed as described above. The application or the supply may in particular be carried out adjacent to the processing device in order optionally to wind around the shaped portion formed in this instance immediately after the shaping processing operation of the workpiece.

In a preferred embodiment, the application device has a gripping device for gripping the fiber strands and/or a separation device for severing the fiber strands. Using the gripping device, a fiber strand which has been introduced by the application device into the vicinity of the surface of the workpiece can be gripped in order to fix the fiber strand to the workpiece. To this end, it is possible to construct on the workpiece a shaped portion, for example, in the form of a fixing gap in which the fiber strand is clamped by means of the gripping device or in which the fiber strand is threaded. To this end, the gripping device is preferably constructed in a rotatable manner so that the gripping device or a gripping element which is fitted thereto, for example, a gripping notch, can be rotated from a position spaced apart from the fiber strand into a gripping position. The fiber strand can then be gripped by the gripping device and be fixed to the workpiece by means of further rotation of the gripping device, for example, by means of threading or clamping in the securing gap.

A development of this embodiment makes provision for the gripping device to act at the same time as a separation device. To this end, the gripping device can be provided with a cutting edge, by means of which the fiber strand is severed. In a rotatable gripping device, the cutting edge may, for example, be provided at a side opposite the gripping element, so that the fiber strand can be severed when the gripping device is rotated counter to the gripping direction.

In another embodiment, the machine tool has a processing device for laser cutting workpieces. The processing device can advantageously be used for precise and rapid separating processing of the workpiece, in particular for cutting free the composite fiber/metal workpiece from the remainder of the workpiece and/or for cutting contours on the metal workpiece in the region in which the fiber fabric is subsequently intended to be fitted.

Other aspects of the invention feature a computer program product, which has encoding means for producing a processing program which is suitable for carrying out all the steps of the method described above (including the variants of the method described above) when the processing program is carried out on a control device of the machine tool.

Other advantages of the invention will be appreciated from the claims, the description and the drawings. The features which have been mentioned above and those which are set out in greater detail below can also be used individually or together in any combination. The embodiments which are shown and described are not intended to be understood to be a definitive listing, but instead are of exemplary character in order to describe the invention.

DETAILED DESCRIPTION

Figure 1:
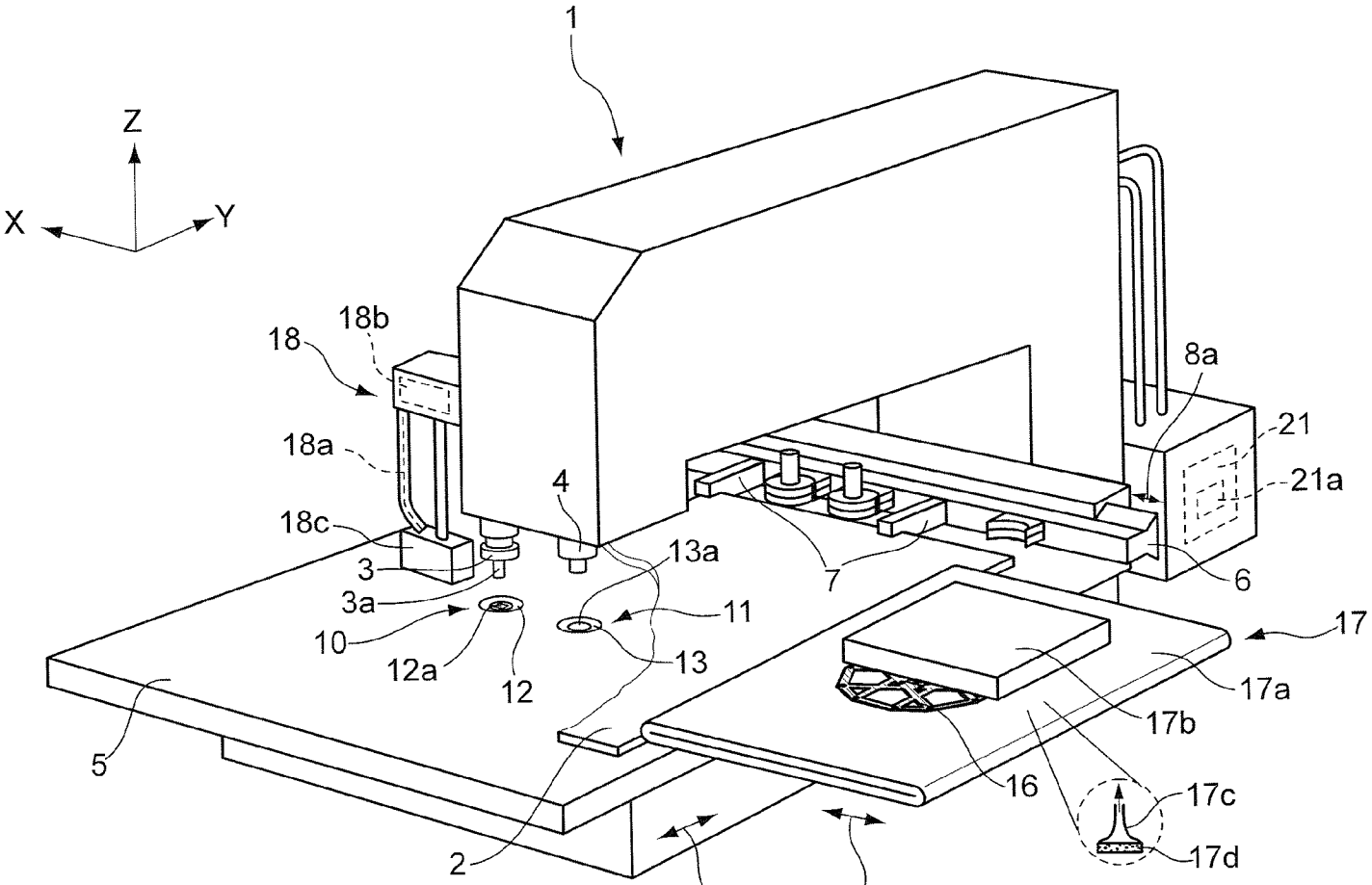
FIG. 1 is a schematic illustration of an example of a machine tool having a device for applying fiber mats to a workpiece and a device for supplying fiber strands to the workpiece.

FIG. 1 shows a machine tool 1 which is constructed as a laser/punching combination machine and which has, as processing tools for the shaping (and optionally separating) processing of a plate-like workpiece 2 in the form of a metal sheet, a conventional punching head 3 having a punching stamp 3*a* and a laser processing head 4 for the separating processing operation. The workpiece 2 to be processed is supported during the workpiece processing operation on a workpiece support 5 in the form of a processing table. Using a conventional retention device 6, which has clamps 7 for holding the workpiece 2 securely, the workpiece 2 can be moved with respect to the punching stamp 3*a* and the laser processing head 4 in the X direction of the workpiece plane (X-Y plane of an XYZ coordinate system) using a linear drive 8*a* which is indicated with a double-headed arrow. In the Y direction of the workpiece plane, the workpiece 2 can be moved by the workpiece support 5, together with the retention device 6, being moved by means of an additional conventional linear drive 8*b* which is indicated by a double-headed arrow.

The workpiece 2 can be moved in this manner in the X and Y directions with respect to the punching stamp 3*a* and the laser processing head 4 so that the region of the workpiece 2 to be processed in each case can be positioned in a fixed processing region 10 of the punching stamp 3*a* or a fixed processing region 11 of the laser processing head 4. In the processing region 10 of the punching stamp 3*a*, there is positioned an (exchangeable) punching die 12 which has an opening 12*a* for engagement for the (also exchangeable) punching stamp 3*a*. Accordingly, there is arranged in the fixed processing region 11 of the laser processing head 4 a laser die 13 which acts as an opening delimitation for a substantially circular suction opening 13*a* in the workpiece support 5.

Figure 6A:
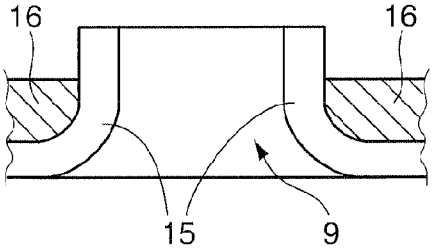
FIGS. 6*a* and 6*b* are sectioned illustrations of a part-region of a workpiece without a metal covering sheet before and after the joining operation, respectively.
Figure 6B:
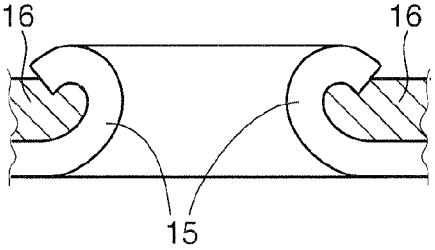
Figure 7:
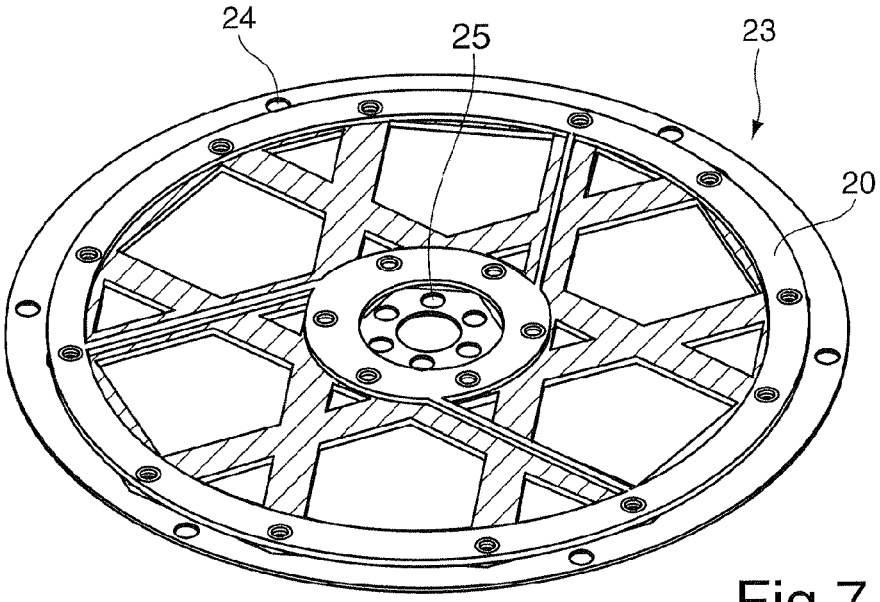
FIG. 7 is a perspective view of a composite fiber/metal workpiece after separation from a remainder of the workpiece.

On the machine tool 1 illustrated in FIG. 1, it is possible to produce composite fiber/metal workpieces, as described below with reference to FIGS. 2 to 6 by way of example for the production of a composite fiber/metal workpiece 23 in the form of a wheel, which is illustrated in FIG. 7. In order to control the linear drives 8*a*, 8*b*, or for the coordination thereof with the processing operation which is carried out at the processing position 10, 11 of the punching stamp 3*a* or the laser processing head 4, a control device 21 is provided in the machine tool 1. The control device 21 uses an NC control program (processing program) whose control commands are carried out during the processing operation. The NC control program (processing program) controls the machine tool 1 or the components thereof in such a manner that all the steps required for the production of a composite fiber/metal workpiece can be carried out. The processing program itself or a corresponding computer program product 21*a* is encoded on one or more computer storage media and has instructions which, when they are carried out by one or more computers, which are typically integrated in the control device 21 or are connected thereto in terms of signal technology, cause the one or more computers to carry out the steps or operations required to produce a composite fiber/metal workpiece.

Figure 2:
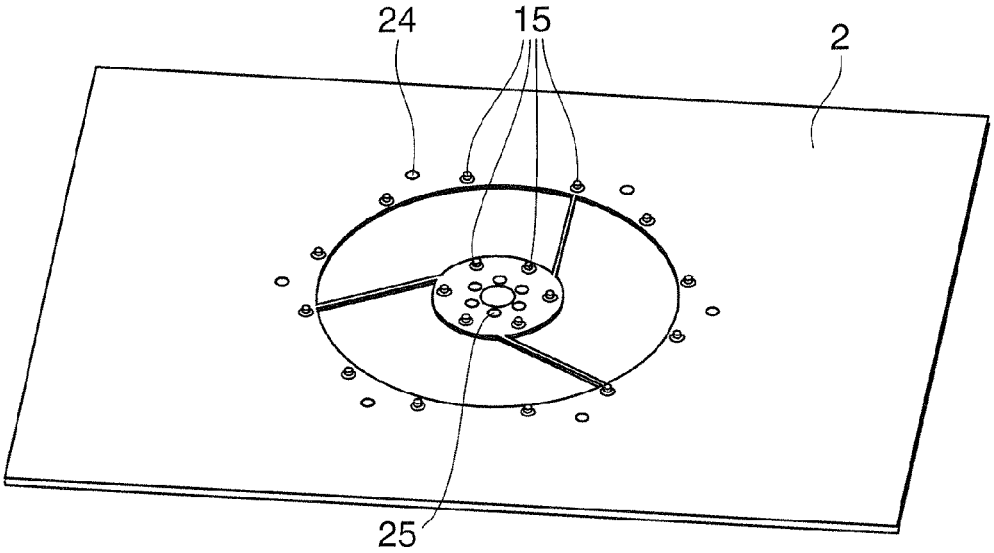
FIG. 2 is a perspective view of a workpiece having shaped portions for further processing to form a composite fiber/metal workpiece.

After the workpiece 2 has been supplied to the workpiece support 5 by means of a transport device (not shown) and the lateral clamping by means of the retention device 6, the workpiece 2 is first subjected to a cutting processing operation using the laser processing head 4 by three annular segments being cut from the workpiece 2, three webs remaining which form the spokes of the wheel (see, for example, FIG. 2). Using the laser processing head 4, there are also cut from the workpiece 2 holes 24, 25 which act as force introduction locations on the outer and inner periphery of the composite fiber/metal workpiece to be produced.

In another processing step, the workpiece 2 is provided with shaped portions 15, that is to say, selected regions of the workpiece 2 are deformed using the punching head 3 or the punching stamp 3*a* so that the deformed regions protrude from the workpiece plane (three-dimensional plastic deformation) to form features extending out of a plane of the surrounding workpiece. In order to produce different types of shaped features, the punching stamp 3*a* can optionally be changed. In the example shown in FIG. 2, shaped features are produced in the form of collar-like rims about holes, which are suitable for producing a non-positive-locking and/or positive-locking connection with respect to a fiber fabric.

Figure 3:
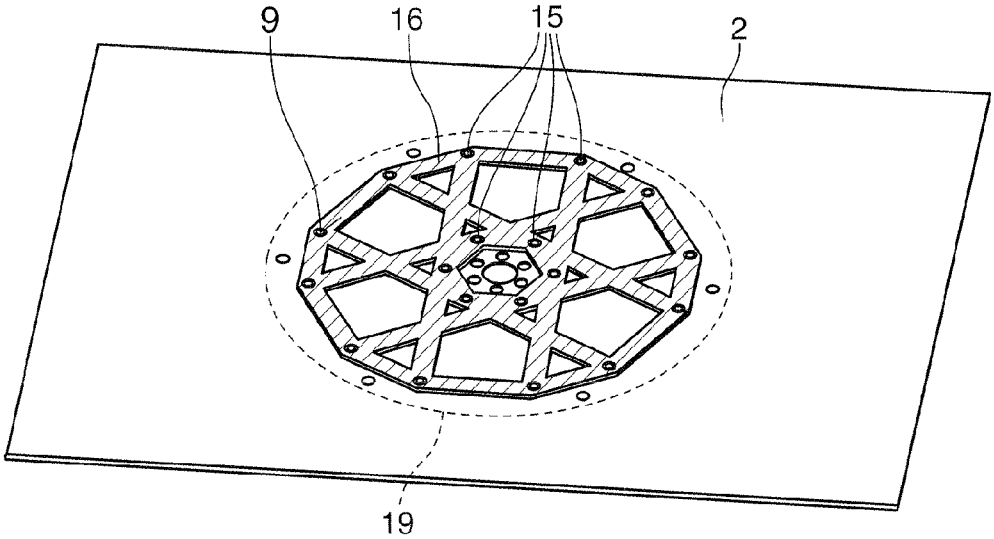
FIG. 3 is a perspective view of the workpiece of FIG. 2 having a fiber mat which is applied in the region of the shaped portions.

In another processing step, a fiber fabric is applied to the workpiece 2. The application is carried out in the present example by positioning a prefabricated fiber mat 16 on the workpiece 2, that is to say, the fiber mat 16 already has the shape and size required for the composite workpiece. The fiber mat 16 is in this instance supplied by means of a device 17 for automatically supplying fiber mats 16 to the workpiece 2 (FIG. 1) and positioned on the workpiece 2 in such a manner that the shaped portions 15 engage in recesses 9 (holes) in the fiber mat 16 (FIG. 3). Owing to the shaped portions 15 which are in engagement with the recesses 9, the fiber mat 16 is retained on the workpiece 2 in the processing plane (XY plane) so that the fiber mat 16 can be moved together with the workpiece 2 without sliding during a subsequent movement of the workpiece 2 in the processing plane. Sliding can also be prevented when there are produced on the workpiece 2 angular, for example, prong-like shaped features which protrude through the fiber mat 16 when it is placed in position and thus bring about fixing of the fiber mat 16 to the workpiece 2.

In the present example, the supply device 17 includes a conveyor belt 17*a* which conveys the fiber mat 16 to the workpiece 2 located on the workpiece support 5, and another linear drive 8*c* for displacing the conveyor belt 17*a* in the X direction. A suitable positioning of the fiber mat 16 in the Y direction can be determined by the selection of the position of the fiber mat 16 on the conveyor belt 17*a* and/or the conveyor belt 17*a* can be moved in the Y direction by means of an additional linear drive (not shown). The depositing of the fiber mat 16 on the conveyor belt 17*a* can, for example, be carried out by means of a gripping device (not shown) or the like.

Of course, the device 17 for automatically supplying fiber mats may also be constructed in a different manner to that shown in FIG. 1. For example, a direct depositing of the fiber mat 16 on the workpiece 2 can be carried out by means of one or more gripping devices, which can be fitted, for example, to an appropriately modified transport device 17*b* for positioning the workpiece 2 on the workpiece support 5. The gripping devices may, for example, be constructed as vacuum suction devices 17*c* which are suitable for gripping the flexible fiber mat 16. For example, it is possible to use as gripping devices for the fiber mat 16 (extensive) suction gripping devices 17*c* which, at the side thereof facing the fiber mat 16, may have an air-permeable component 17*d*, for example, in the form of a (planar) sieve or an air-permeable layer of an open-pore material, for example, of foam, through which the suction can be carried out. Of course, it is possible to dispense with the conveyor belt 17*a*, or the conveyor belt 17*a* can be used for supplying fiber mats 16 to a transfer position in the region of the transport device 17*b*, at which position the transport device receives a respective fiber mat 16.

Regardless of the precise construction of the device 17, the fiber mat 16 or the recesses 9 in the fiber mat 16 is brought into the region of the workpiece 2 at which the shaped portions 15 are formed in order to prevent a sliding of the fiber mat 16 relative to the workpiece 2 during the subsequent shaping processing operation. The control device 21 serves to control the device 17 (of the conveyor belt 17*a* and the linear drive 8*c* and/or the transport device 17*b*) and to coordinate with a displacement of the workpiece 2 using the linear drives 8*a*, 8*b*, which displacement may be necessary for precise positional placement.

As an alternative to supplying a fiber mat 16, the fiber fabric or portions thereof can also be produced directly on the workpiece located in the machine tool 1. To this end, a fiber strand 18*a* (also called fiber roving) is automatically supplied by means of an additional supply device 18 into the region of the punching head 3 or the processing region 10 which is associated therewith and wound around the shaped portions 15 previously produced at that location. In the present example, a fiber strand 18*a* is unwound from a magazine in the form of a coil 18*b* which is fitted to the C-shaped machine frame of the machine tool 1. The coil 18*b* may optionally be provided with a drive (not shown) in order to convey fiber strands 18*a*. Naturally, the transport or the storage of the fiber strands 18*a* can also be carried out at another location in the machine tool 1.

The workpiece 2 is preferably moved using the machine axes of the machine tool 2 relative to the device 18 in such a manner that the winding action around the shaped features 15 of the workpiece 2 is carried out as a result of the relative movement of the workpiece 2 relative to the output-side end of the supply device 18 or an application device 18*c* which is provided at that location. The application device 18*c* also serves to fix a respective fiber strand 18*a* to the workpiece 2 before and after the shaped portions 15 have been subjected to winding. To this end, it is possible to form on the workpiece 2 by means of the punching head 3 and/or by means of the laser processing head 4 a narrow gap in which the fiber strand 18*a* is introduced and securely clamped with the (free) end thereof.

Figure 8:
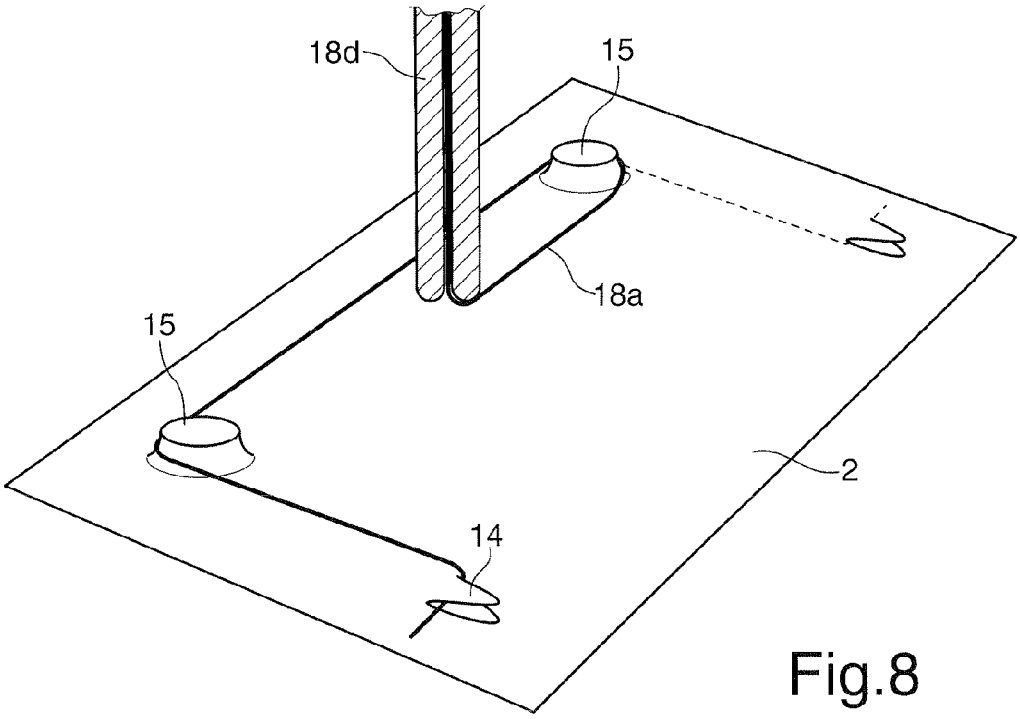
FIG. 8 shows a workpiece during the application of a fiber roving.

FIG. 8 shows such an application operation. The fiber strand 18*a* is supplied to the workpiece 2 by means of the inner side of a tubular thread guide 18*d*. There is provided in the workpiece 2 a V-shaped gap 14 on which the end of the fiber strand 18*a* protruding from the end of the thread guide 18*d* can be fixed. After fixing the fiber strand 18*a*, the fiber strand 18*a* can be wound around the shaped portions 15 in order to form a fiber fabric. After the winding operation is complete, the fiber strand 18*a* can be fixed to the same gap 14 or to an additional gap or a suitable shaped portion.

Figures 9A, 9B, 9C, 9D, 9E, 9F, 9G, 9H:
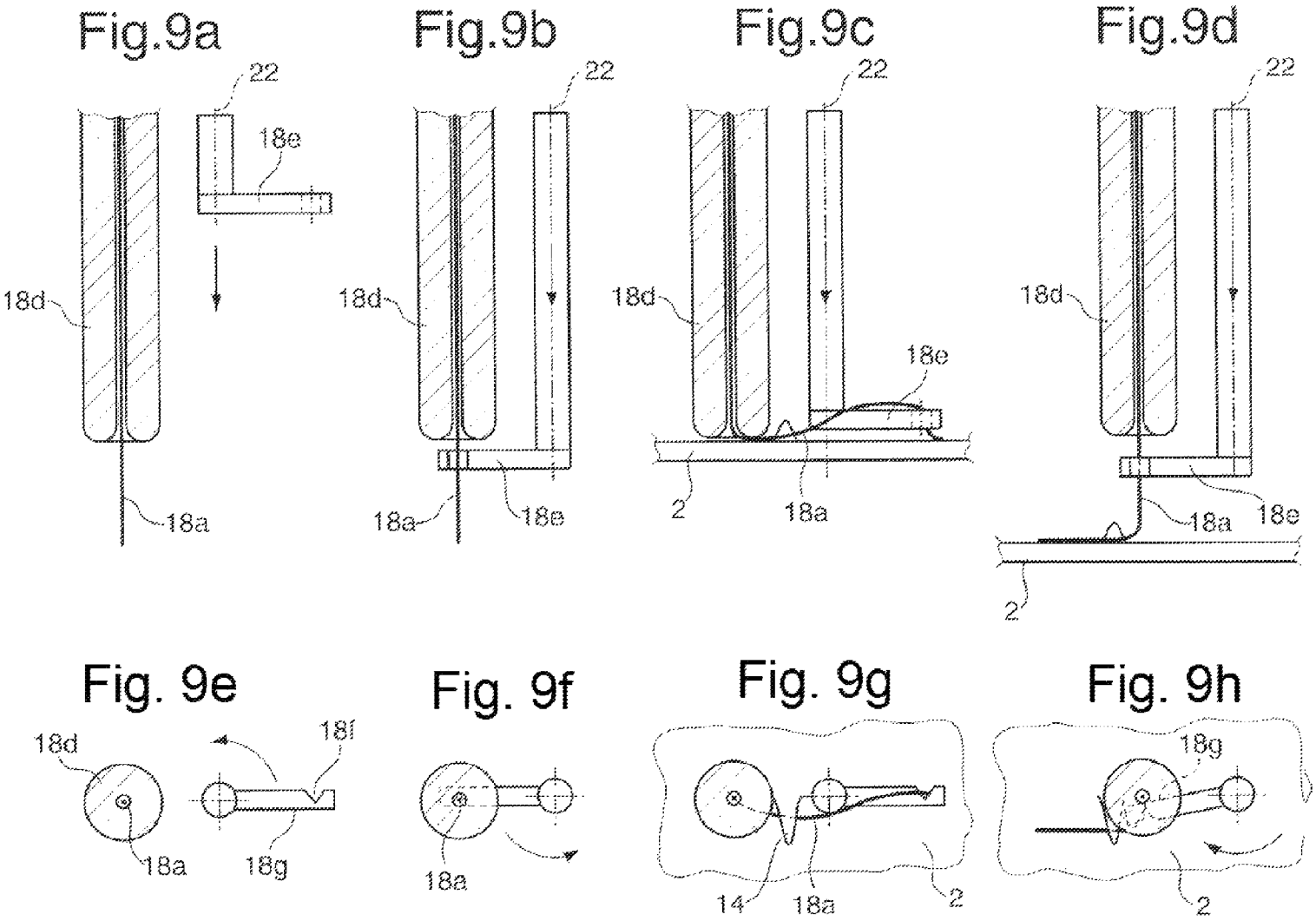
FIGS. 9*a*-9*d* and FIGS. 9*e*-9*h* are lateral sectioned illustrations and corresponding plane views of a portion of an application device during various phases of the application operation of the fiber roving, respectively.

FIGS. 9*a-h* show how such a fixing of the fiber strand 18*a* can be produced. The workpiece 2 is moved in such a manner that the fiber guide 18*d* is located in a position adjacent to the gap 14. The application device shown in FIG. 9*a-h* includes a gripping device 18*e* which can be moved along the thread guide 18*d* (perpendicularly relative to the workpiece surface) and rotated about an axis 22 (perpendicularly relative to the workpiece surface) (FIGS. 9*a* and 9*e*). In order to fix the fiber strand 18*a*, the gripping device 18*e* is moved to a height below the end of the thread guide 18*d* and subsequently rotated in a gripping device about the axis 22 so that the fiber strand 18*a* moves into engagement with a gripping element which is arranged in an eccentric manner with respect to the axis 22 and which is in the form of a gripping notch 18*f* of the gripping device 18*e* (FIGS. 9*b* and 9*f*). By means of further rotation of the gripping device 18*e* in the gripping direction, the fiber strand 18*a* is pulled out of the thread guide 18*d* and a loop is formed between the thread guide 18*d* and the gripping device 18*e*. In order to thread the fiber strand 18*a* into the gap 14, the thread guide 18*d* and the gripping device 18*e* are lowered onto the surface of the workpiece 2*a* (FIGS. 9*c* and 9*g*) and the workpiece 2 is moved in an appropriate manner until the fiber strand 18*a* is clamped in the gap 14. A corresponding fixing can also be carried out after the winding operation is complete in order to prevent the fiber strand 18*a* which has been wound around the shaped portions 15 from becoming detached independently.

In the present example, the supply device 18, more specifically the application device 18*c*, has a cutting device 18*g* in order to sever a respective fiber strand 18*a* after the fiber fabric has been produced or after portions of the fiber fabric have been produced. The cutting device 18*g* can be used to separate the fiber strand 18*a* after the fixing operation, as shown in FIGS. 9*d* and 9*h*. The cutting device 18*g* is constructed in the example shown in the form of a cutting edge which is provided at a side of the gripping device 18*e* opposite the gripping notch 18*f*. In order to sever the fiber strand 18*a*, after the fiber strand 18*a* has been introduced into the fixing gap 14, the thread guide 18*d* and the gripping device 18*e* can first again be moved away from the surface of the workpiece 2 or the securing gap 14. During or after this movement, the gripping device 18*a* can be rotated counter to the gripping direction, the fiber strand 18*a* coming into contact with the cutting edge 18*g* and being severed thereby.

The supply device 18 is installed in a fixed manner in the present example and may be constructed in a similar manner to a wire supply for welding or the thread supply in a textile machine, for example, in a sewing machine. However, it is also possible to leave the workpiece 2 in a fixed manner and to move the fiber rovings 18*a* around the shaped portions 15 using movable components of the supply device 18, in particular the application device 18*c*. Of course, the workpiece 2 may optionally also be moved in the XY-plane in addition in this instance.

It is further self-evident that, when fiber rovings 18*a* are used to produce the fiber fabric, the production of shaped portions 15 does not have to take place in a first step and the fitting of the fiber fabric does not have to take place in a second step, as illustrated in FIGS. 2 and 3. Instead, it is optionally possible for a fiber roving 18*a* to be wound around a respective shaped portion 15 directly after production of a respective shaped portion 15, before the workpiece 2 is displaced in order to form a shaped portion at another location.

Figure 4:
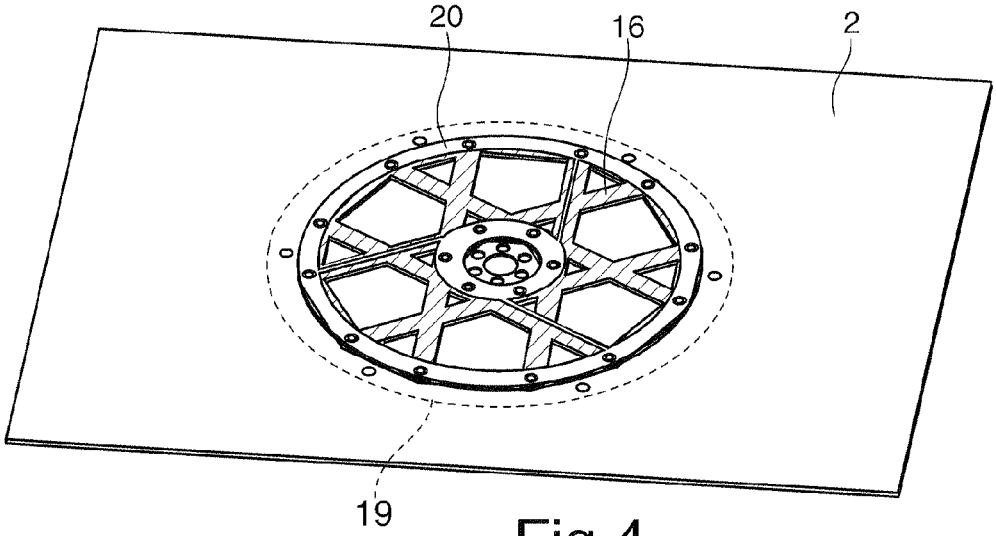
FIG. 4 is a perspective view of the workpiece of FIG. 3 with the fiber mat and a metal covering sheet applied.

In both of the cases described above, there is produced a fiber fabric 16 which can be moved together (that is to say, without relative movement) with the workpiece 2 in the processing plane so that in a subsequent processing step in the region of the shaped features 15, a non-positive-locking and/or positive-locking connection is produced between the workpiece 2 and the fiber fabric 16 and a composite fiber/metal workpiece can consequently be produced. For the production of the connection, a pre-fabricated metal covering sheet 20 can be placed on the fiber mat 16 and the fiber mat 16 can be clamped between the two metal sheets 2, 20 (FIG. 4). The mechanical clamping connection is preferably produced during punching operation, for example, by means of crimping, punch-riveting or clinching, for which the shaped features 15 formed in the previous step can be deformed.

Figure 5A:
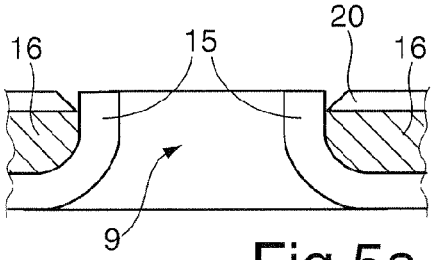
FIGS. 5*a* and 5*b* are sectioned illustrations of a part-region of a workpiece with a fiber fabric and metal covering sheet applied before and after the joining operation, respectively.
Figure 5B:
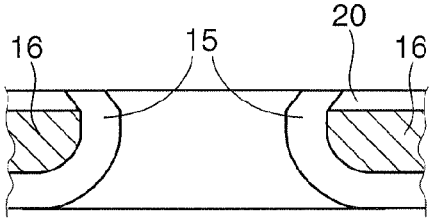

FIGS. 5*a* and 5*b* show a section through a shaped portion 15 of the workpiece 2 which is provided with the fiber mat 16 before and after the deformation of the shaped portions 15, respectively. As can be seen with reference to FIGS. 5*a* and 5*b*, using the punching head 3, the collars of the shaped features 15 which are formed as rim holes are bent outwards so that a crimped edge is produced which engages over inclined portions or chamfers provided on the metal covering sheet 20 and fixes the fiber mat 16 in this manner.

FIGS. 6*a* and 6*b* show a cross-section through a shaped portion 15 of the workpiece 2 which is provided with the fiber mat 16 and in which, in contrast to FIGS. 5*a* and 5*b*, a metal covering sheet for producing the non-positive-locking and/or positive-locking connection has been dispensed with. Using the punching head 3 of the machine tool 1, the collars of the rim holes 15 are also bent outwards in this instance so that they engage over the fiber mat 16. The regions which are bent outwards are in the present example constructed in a claw-like manner in order to clamp the fiber mat 16 and consequently to produce a positive-locking and non-positive-locking connection.

The connection of the fiber mat 16 to the workpiece 2 can be carried out as described above in the region of the shaped features 15, which also serve to fix the fiber mat 16 in the x-y direction. In this manner, a positive-locking connection of the workpiece/fiber fabric/metal covering sheet sandwich is achieved. However, it is also possible, before or after the fiber mat 16 has been positioned, to introduce additional shaped portions (not shown) into the workpiece 2, for example, outside the region in which the fiber fabric 16 is applied or is intended to be applied. The connection of the workpiece 2 and fiber mat 16 can additionally or exclusively be carried out by means of these additional shaped portions, which are preferably formed adjacent to the fiber mat 16 on the workpiece 2 and which after shaping or deformation at least partially extend over the workpiece region covered by the fiber mat 16. The workpiece 2, the fiber mat 16 and an optionally present covering metal sheet may also be shaped together, for example, in the form of a crimped portion in order to thus produce a non-positive-locking and/or positive-locking connection.

Of course, the procedure shown with reference to FIGS. 5*a* and 5*b* and FIGS. 6*a* and 6*b* for non-positive-locking and/or positive-locking connection of the fiber mat 16 and workpiece 2 can also be used in a similar manner to the non-positive-locking and/or positive-locking connection of the workpiece 2 and a fiber fabric produced from fiber rovings. It is also self-evident that part-regions of the fiber fabric can be constructed as fiber mats and other part-regions can be constructed in the form of fiber rovings.

After the joining operation, the fiber/metal composition is separated from the workpiece 2 in a last processing step along a cutting contour 19. This can be carried out by means of laser cutting using the laser processing head 4 or optionally by means of nibbling using the punching head 3. The completed composite fiber/metal workpiece 23 (FIG. 7) can then be discharged from the machine tool 1 by means of a transport device which is not illustrated in the Figures. Although the possibility of cutting or separation of the composite fiber/metal workpiece 23 from the remaining workpiece directly on the machine tool 1 is advantageous, this processing step may also be carried out where applicable at another location. This is optionally advantageous when the above-described production operation is not carried out as illustrated in FIG. 1 on a laser/punching combination machine 1, but instead a punching machine without a laser cutting function is used for the production of the composite workpiece 23.

The method described above and the associated machine tool enable the production of composite workpieces of metal and fiber fabrics as a pre-step for the production of planar or spatially shaped hybrid components of metal and fiber/plastics material composites. Composite fiber/metal workpieces 23 which have been produced in the manner described above can in other processing steps, for example, by means of bending, be shaped in a three-dimensional manner and subsequently be infiltrated with resin in a tool, for example, in the RTM ("Resin Transfer Molding") method or be injection-molded around with a thermoplastic material.

In the method described above, the composite is produced by means of a direct force transmission between the metal sheet and fibers by means of non-positive-locking and/or positive-locking connection. Both the processing of the metal workpiece and the connection of the workpiece to the fiber fabric can be carried out in one and the same machine tool, that is to say, the cutting of the sheet metal component, the connection of the workpiece to the fiber fabric and optionally also the production of the fiber fabric can be carried out in a single operating step and consequently composite fiber/metal workpieces can be produced in a particularly economical manner.

A number of embodiments of the invention have been described. Nevertheless, it will be understood that various modifications may be made without departing from the spirit and scope of the invention. Accordingly, other embodiments are within the scope of the following claims.

What is claimed is:

1. A method of producing a composite fiber/metal workpiece, the method comprising:

locating a metal workpiece on a workpiece support of a machine tool;

processing the located metal workpiece using a processing device of the machine tool to shape at least one region of the metal workpiece;

fitting a fiber fabric to the shaped region of the metal workpiece; and using the processing device of the machine tool, connecting the fitted fiber fabric to the metal workpiece to produce the composite fiber/metal workpiece, wherein processing the metal workpiece to shape the region of the metal workpiece comprises punching the metal workpiece, wherein fitting the fiber fabric comprises supplying at least a portion of the fiber fabric in the form of a fiber mat to the workpiece while the workpiece is located on the workpiece support, and wherein the shaped region comprises a feature extending from a surrounding region of the metal workpiece, and wherein fitting the fiber fabric to the metal workpiece comprises positioning the fiber mat on the metal workpiece such that the feature of the metal workpiece is received into a hole defined in the fiber mat.

2. The method of claim 1, wherein punching the workpiece raises a rim of material of the workpiece in the shaped region about a hole formed by the punching.

3. The method of claim 1, wherein the fiber fabric is connected to the metal workpiece by deforming the shaped region of the metal workpiece.

4. The method of claim 1, further comprising:

applying at least one cover over the fiber fabric fitted to the metal workpiece, and wherein connecting the fiber fabric to the metal workpiece comprises clamping the fiber fabric between the metal workpiece and the cover.

5. The method of claim 1, further comprising separating the composite fiber/metal workpiece from a remainder of the metal workpiece by cutting the metal workpiece.

6. A method of producing a composite fiber/metal workpiece, the method comprising:

locating a metal workpiece on a workpiece support of a machine tool;

processing the located metal workpiece using a processing device of the machine tool to shape at least one region of the metal workpiece;

fitting a fiber fabric to the shaped region of the metal workpiece; and using the processing device of the machine tool, connecting the fitted fiber fabric to the metal workpiece to produce the composite fiber/metal workpiece, wherein fitting the fiber fabric comprises producing at least a portion of the fiber fabric by winding fiber strands around raised regions of the metal workpiece formed by processing the metal workpiece.

7. The method of claim 6, wherein the fiber strands are supplied to the metal workpiece from a magazine.

8. The method of claim 6, wherein the fiber strands are wound around shaped portions of the metal workpiece while the metal workpiece is moved relative to the processing device.

9. The method of claim 6, wherein the fiber fabric is connected to the metal workpiece by deforming the shaped region of the metal workpiece.

10. The method of claim 6, further comprising:

applying at least one cover over the fiber fabric fitted to the metal workpiece, and wherein connecting the fiber fabric to the metal workpiece comprises clamping the fiber fabric between the metal workpiece and the cover.

11. The method of claim 6, further comprising separating the composite fiber/metal workpiece from a remainder of the metal workpiece by cutting the metal workpiece.

12. A non-transitory computer readable storage medium storing instructions executable by one or more computers and upon such execution causing the one or more computers to perform operations to produce a composite fiber/metal workpiece, the operations comprising:

locating a metal workpiece on a workpiece support of a machine tool;

processing the metal workpiece located on the workpiece support to produce one or more shaped features of the metal workpiece;

fitting a fiber fabric to the features of the metal workpiece; and connecting the fiber fabric to the metal workpiece to produce the composite fiber/metal workpiece, wherein processing the metal workpiece to shape the region of the metal workpiece comprises punching the metal workpiece, wherein fitting the fiber fabric comprises supplying at least a portion of the fiber fabric in the form of a fiber mat to the workpiece while the workpiece is located on the workpiece support, and wherein the shaped region comprises a feature extending from a surrounding region of the metal workpiece, and wherein fitting the fiber fabric to the metal workpiece comprises positioning the fiber mat on the metal workpiece such that the feature of the metal workpiece is received into a hole defined in the fiber mat.

* * * * *